United States Patent [19]

Blach

[11] 4,020,773

[45] May 3, 1977

[54] SLUICE FOR CLINKER AND ASHES

[75] Inventor: Evald Blach, Glostrup, Denmark

[73] Assignee: Aktieselskabet Volund, Abildager, Denmark

[22] Filed: July 28, 1975

[21] Appl. No.: 599,343

[30] Foreign Application Priority Data

July 29, 1974 Denmark ..... 4054/74

[52] U.S. Cl. ..... 110/165 R; 110/171

[51] Int. Cl.[2] ..... F23J 1/06

[58] Field of Search ..... 110/165 R, 170, 171

[56] References Cited

UNITED STATES PATENTS

| | | | |
|---|---|---|---|
| 1,795,357 | 3/1931 | Allen | 110/165 |
| 1,819,486 | 8/1931 | Sherman | 110/171 |
| 2,037,990 | 4/1936 | Martin | 110/171 |
| 3,734,037 | 5/1973 | Martin | 110/165 |

*Primary Examiner*—Kenneth W. Sprague
*Attorney, Agent, or Firm*—Pennie & Edmonds

[57] ABSTRACT

The invention relates to a sluice for sluicing out clinker and ashes from a furnace, where the sluice is arranged in a residue shaft situated, for instance, at the end of a fuel-transporting grate in a furnace or at the end of a rotary kiln. The sluice is divided into an upper chamber and a lower chamber by a sluice flap which can pivot downwards, said lower chamber ending in a collecting compartment arranged at the bottom of the shaft, from where the clinker and ashes by means of a scraper are forced through an opening for further disposal.

8 Claims, 2 Drawing Figures

SLUICE FOR CLINKER AND ASHES

BACKGROUND OF THE INVENTION

1. Field of the Invention

The invention relates to a sluice for sluicing out clinker and ashes from a furnace.

2. Description of the Prior Art

The known sluice construction with only one sluice flap has certain advantages compared with the structure which besides the upper sluice flap also is provided with a lower sluice flap wherein the material, when the latter sluice flap is opened, falls down into an arrangement for carrying away said material, and wherein the two flaps lock a sluice chamber so that any risk of false draft up through the shaft when sluicing is prevented. The construction height of the inventive sluice as stated previously is far less than that of prior art, and the structural claims will therefore be substantially reduced.

Furthermore, the discharge of material for further conveyance on, for instance, a conveyor belt can be controlled so that the belt is not overloaded by a suddenly occurring heavy load, which may happen using the above-mentioned structure, when the lower flap is opened and the entire contents of the sluice chamber are discharged at the same time.

However, in the case of a sluice having only one sluice flap, the problem lies in creating a sufficiently tight lower closure for the sluice chamber.

The collecting compartment of certain known sluices of this type is arranged as a water trap, the lower part of the shaft being filled with water and having a damper extending below water level, respectively, the lower part of a shaft wall being prolonged, having outside it a water basin. By means of a scraper conveyor or other suitable conveying means, the discharged clinker and ashes are moved to the water basin, the airtight locking of the shaft being provided by the water trap. This is an excellent solution as far as the sluicing effect is concerned, but is nevertheless subject to major drawbacks. Thus, the gathering of slurry in the water basin causes blocking of grates and drains, and the abundant quantity of water that has to be drained off will be strongly polluted just as the further conveyance of the drenched clinker and ashes from the bottom of the basin results in dirtying of the surroundings. Finally, it is difficult or impossible in this way to rid a shaft of larger residual pieces which, for instance in a combustion plant for trash, often will be present together with the clinker and ashes falling into the shaft. This results in such residual pieces becoming lodged in the shaft or at the best removed from there with much difficulty. In any case, the construction of such plants will have to be very strong and robust and will be correspondingly expensive to install and maintain where, for instance, there is question of hard wear caused by a scraper conveyor.

It has also been suggested to form the water trap by extending the bottom of the shaft to incline upwards past the side facing the downwards protruding damper shaft wall like a scraper ramp provided with side walls, said ramp ending in a discharge edge situated higher than the lower edge of the downwards protruding shaft wall, and over which the scraped clinker and ashes are pushed and fall down into a transportation system for further disposal. In this structure, where the wall part protruding down in the water possibly may be displaceable in a vertical direction through the action of the waste pushed out, the above disadvantages as regards lodging and removal of large residual pieces do not manifest themselves very markedly. However, particulary large residual pieces, common in the case of the burning of waste, often will be incapable of pushing the slidable wall part up, so that the removal of such pieces involves extra work. Furthermore, the drenched material pushed over the edge of the ramp will give rise to considerable drawbacks, just as the lack of a proper water basin will make a frequent supply of water necessary in order to maintain the water trap.

However, it is also known to sluice out without the use of a water trap, as the dry clinker and ashes that have fallen down into the collecting compartment are pushed out through the side of the collecting compartment respectively through a tunnel-like outlet at the bottom of the shaft wall by means of a suitable conveyor, for instance a screw conveyor, or a suitable piston in the tunnel which by its piston rod extending through a bushing in the shaft wall is moved backwards and forwards and gradually pushes the material out through the tunnel. When this material contains a relatively large quantity of ashes in relation to residual pieces the part that at any time remains in the tunnel will form a sufficiently tight closure for a sluice chamber. However, in this structure there is a great risk of lodging of the material, and larger residual pieces or pieces of clinker smelted together may result in overload and will only with difficulty, if at all, be discharged through the tunnel, their removal thus demanding difficult manual work.

It is the purpose of the invention to provide a sluice of the type stated previously, in which the drawback stated in the above-mentioned known structure will not be present, while the stated advantages of these structures are maintained. In the sluice according to the invention the sluicing out takes place without the use of a water trap, and the conditions for easily sluicing out voluminous pieces of the clinker material are particularly favorable.

SUMMARY OF THE INVENTION

According to the invention, the collecting compartment for clinker and ashes is shaped as a trough open on the one side with a discharge edge placed at a distance from the shaft such that the mass of clinker and ashes resting on the bottom of the trough within said edge can form a natural slope from the lower edge of the shaft wall, said edge being the upper bounding line of the opening, and to the bottom thereby forming a mainly tight closure for the lower compartment of the residue shaft. The forward pushing movement of the scraper is limited so that its front edge is situated with the vertical projection of the shaft wall closest to the discharge edge.

According to the invention, the collecting compartment can be arranged as a trough closed on all sides except for the discharge opening, in which trough the scraper together with its driving mechanism and controlling devices are situated.

The sluice according to the invention is in particular intended for use in connection with a combustion plant for household waste or industrial residue, where the clinker and ashes from such a combustion, especially in the case of plants where the last phase of the combustion at any rate takes place in a rotary kiln, have an extremely high temperature (1000° C or more) that may be too much for the scraper mechanism working in the receiving trough. Furthermore, the hot material causes dust nuisance and has other drawbacks, possibly damage to the scraper and the conveyor means used for further transportation.

In the case of the above-mentioned clinker sluices provided with two flaps and intermediary sluicing chamber it has been suggested (cf. U.S. patent application Ser. No. 450.805 filed Mar. 13, 1974, now U.S. Pat. No. 3,933,103 to Mikkelsen) by means of nozzles in the chamber wall to spray water over the material present in the sluice chamber, so that the last-mentioned disadvantages may be avoided. Such water supply to the sluice chamber itself in the case of the sluice according to the invention will certainly eliminate the drawbacks connected with the further transportation of the material, but it will not prevent the adverse effect on the scraper mechanism of the clinker and ashes not yet cooled off.

In order to obtain the intended cooling of the clinker material before it reaches the collecting compartment, there may, according to the invention, in the wall on the upper section of the shaft be placed nozzles for spraying water over the clinker material resting on the sluice flap thereby cooling said material.

In the case of the burning of waste, rather voluminous residual pieces may appear in the falling material, and in order to render possible the sluicing out of pieces that extend beyond the upper edge of the discharge opening the lower part of the shaft wall, the lower edge of which forms the upper boundary of the discharge opening, may according to the invention be designed as a swing flap hanging on hinges which flap can open outwards when pushed from the inside.

The difficult work involved in manually removing such residual pieces from the collecting compartment can thus be prevented. On the other hand, the discharge of such pieces may involve the risk of temporary false draught up through the shaft, and a heap of ashes rising above the surface of the material being pushed out may prevent the swing flap from immediately pivoting backwards after the passage of the residual piece and thereby give access of false draught. In order to neutralize this drawback, the swing flap in out-position may, according to the invention, be made to swing back by counterweight or using a spring. By this extra return-force ashes and clinker that may be hindering the backwards swinging are pushed backwards and the flap will occupy its normal vertical position which it will keep without being swung out by the pushing from the ashes and the loose clinker that form the top of the material pushed out.

BRIEF DESCRIPTION OF THE DRAWINGS

The invention will be further described in connection with the example of an embodiment of a sluice according to the invention shown schematically on the drawing, and where.

DETAILED DESCRIPTION OF THE PREFERRED EMBODIMENTS

Figure 1:
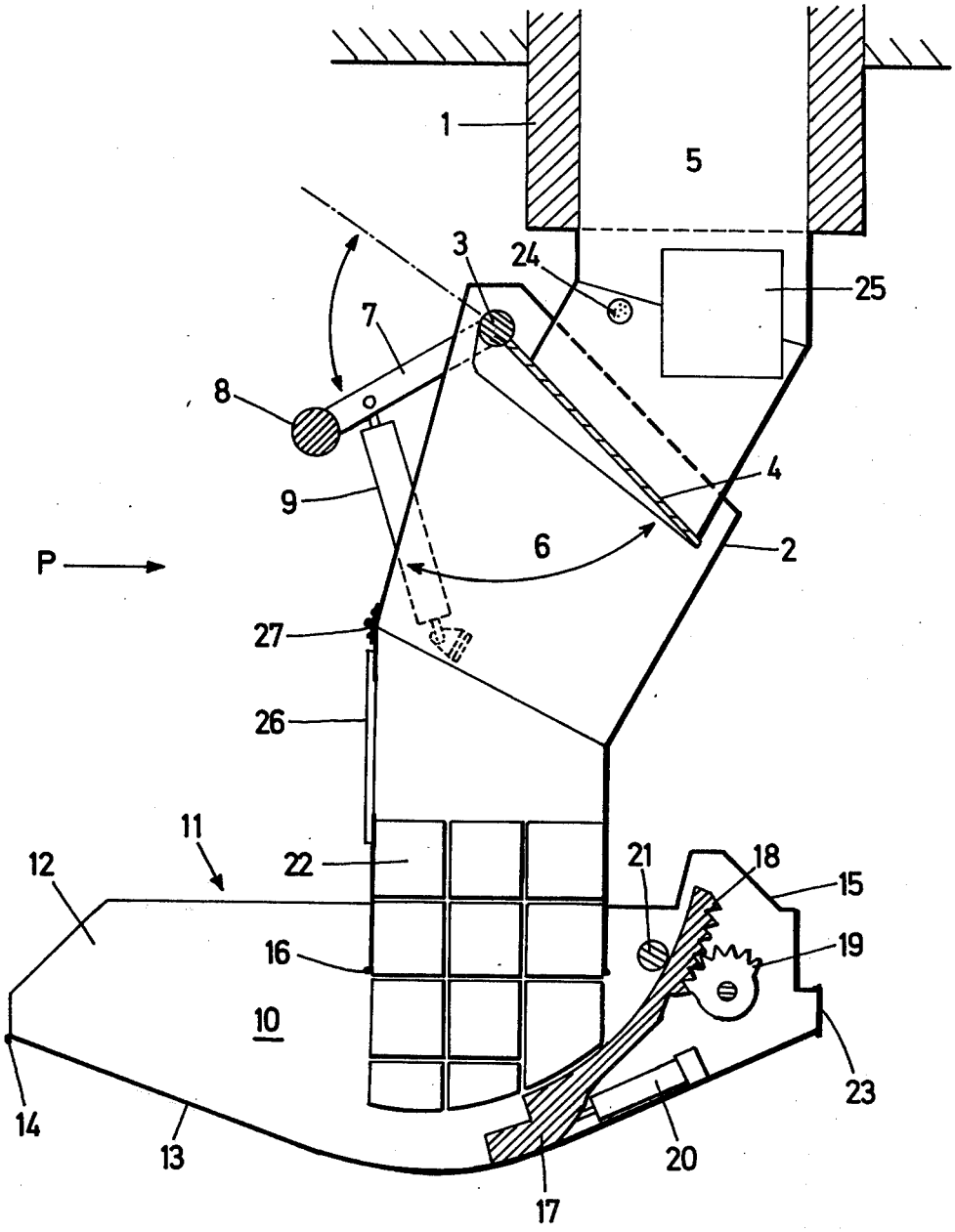
FIG. 1 shows a vertical longitudinal section through the sluice.
Figure 2:
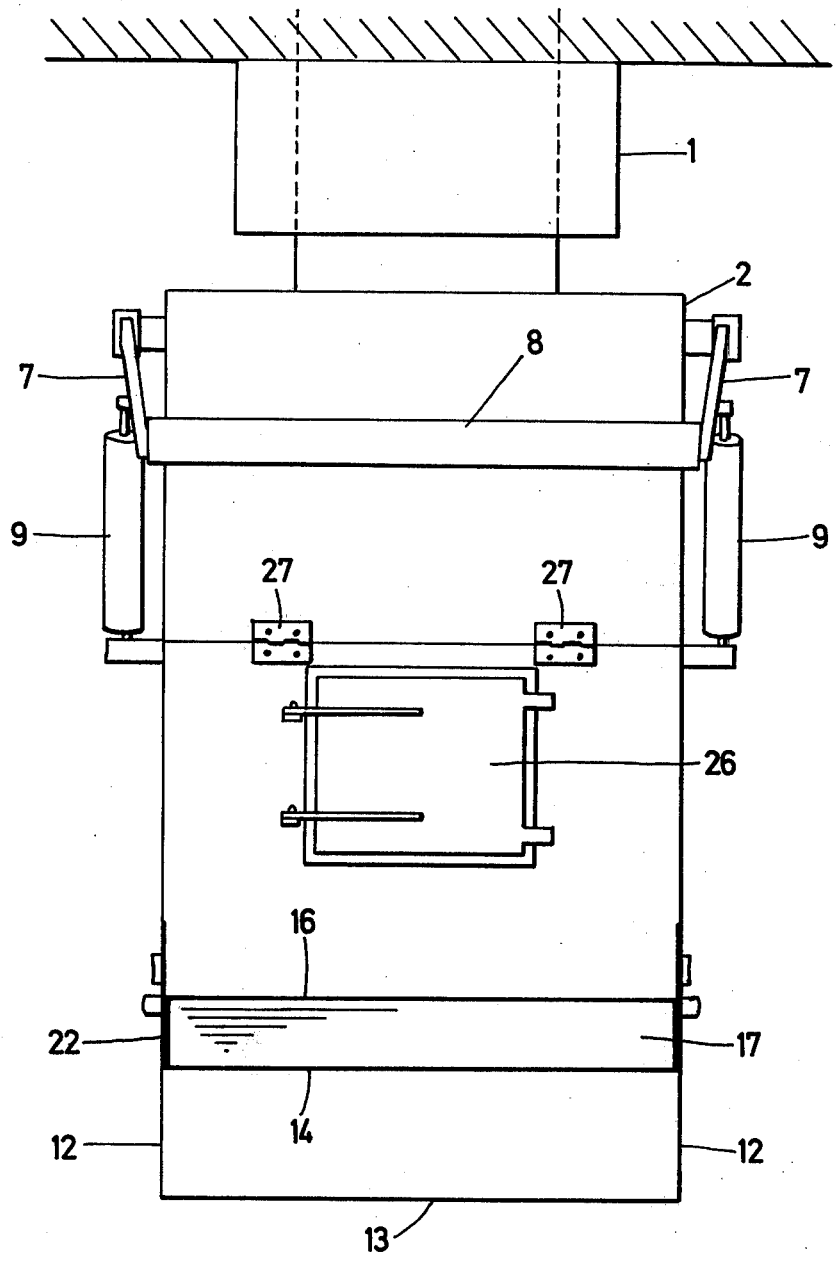
FIG. 2 shows the sluice in elevation seen from outside in the direction of the arrow P in FIG. 1.

The shaft for clinker and ashes situated at the end of the grate (not shown) of the furnace consists of a vertically built brick shaft 1 extending downwards in a sheet iron shaft 2 having a deflection. In this shaft is placed a sluice flap 4 fixed on a pivotally embedded axle 3, said flap in the shown closed position dividing the shaft 1, 2 in an upper section 5 and a lower section 6. To each of the terminals of the axle 3 extending through the shaft wall a rigidly protruding arm 7 is secured, said arm carrying a common counterweight 8 and being connected to a pneumatically operated cylinder 9 mounted pivotally outside on the shaft for movement of the flap 4 between the shown closed position and hanging open position.

The shaft section 6 ends at the bottom in a collecting compartment 10 formed by a trough 11 having mainly plane end walls 12 and a curved botton 13 being cylinder-shaped at its middle part and continuing to both sides in a plane section at the one side ending in a discharge edge 14 and at the other side continuing in a superstructure 15 which together with the shaft wall and the end walls of the trough forms a tight closure of the collecting compartment 10 on that side. The superstructure 15 is provided with an inspection shutter 23. The lower edge 16 of the shaft wall closest to the discharge edge 14 is situated at a somewhat higher level than the latter edge which is positioned at some distance from the shaft.

In the trough a scraper 17 is placed which is shaped mainly as a cylinder section, said scraper being provided with a gear segment 18 at the back of its rear end, which segment engages a pivotally mounted gear sector 19. A transverse supporting rod or roller 21 maintains the gear segment 18 engaged with the gear sector 19. The scraper 17 glides against the bottom of the trough with its other end the front side of which is stepped, and here it is connected to a hydraulically operated cylinder 20 mounted in the trough and positioned between the bottom of the trough and the scraper. The shaft walls situated in flush with the end walls 12 of the trough are provided with a covering of wearing plates 22 extending downwards along the end walls, but not quite down to the bottom of the trough, leaving some space between same and the thus concentrically shaped lower edge of the wearing plate covering so that the side edges of said scraper being moved between the bottom of the trough and the wearing plates 22 may pass.

In the wall of the upper shaft section 5 nozzles 24 are placed for spraying water, and both the upper section 5 and the lower section 6 are provided with inspection hatches 25 and 26 respectively.

The sluice operates as follows:

The waste material falling into the shaft settles on the closed sluice flap 4, where it is sprayed by nozzles 24 with a suitable quantity of water in order to cool the hot clinker and ashes without wetting these particularly. At intervals of for instance five minutes flap 4 is opened, and the cooled clinker falls down into trough 11, upon which the flap is again closed. At relatively brief intervals the scraper 17 is pushed forward by means of the hydraulic cylinder 20 a distance corresponding to the working length between the gear segment 18 and the cog section 19. The clinker is thereby pushed forward along the upwards inclining part of the trough bottom 13 towards the discharge edge 14, and in this way the heap of clinker and ashes thus collected almost entirely close the opening limited by the lower edge 16 of the shaft wall, the sides 12 of the trough and the bottom 13. This closing is maintained, as the quantity of material discharged from the front of the heap by the action of the scraper is replaced by the falling clinker and ashes through the periodic opening of sluice flap 4. As the height of all of this material may be made low, and the quantity of the material supplied through each forward movement of the scraper is limited, dust nuisance is also prevented, just as the transportation means, for instance a belt conveyor, can be of relatively light and correspondingly inexpensive construction, as it is not exposed to impact loads.

The lower part of the shaft wall the lower edge 16 of which forms the upper boundary of the discharge opening of the trough may be arranged as a swing flap hinged on the above situated firm wall part by hinges 27. Said wall section may thus swing out and allow the passage of residual pieces or the like that are particularly high. This wall section may be operated by a counterweight or a spring so that it swings back again after the high piece in question has passed.

The opening and the closing of the sluice flap 4, the water supply to the nozzles 24 and the movement of the scraper 17 may be controlled automatically at predetermined intervals, but the mechanism for this, which mechanism possibly may also control the further disposal of the residue and moreover can be of various designs is not described as it does not constitute part of the invention.

The sluice according to the invention may within the framework of the following claims be arranged in another way than the shown embodiment. Thus, the scraper may be of another construction, for instance similar to the known piston pushers, and the discharge opening from the collecting compartment may be arranged otherwise than shown, as long as it provides the possibility of collecting a residue heap that permanently closes the opening.

What we claim is:

1. An apparatus for removing burnt material such as clinker, combusted or uncombusted residual material and the like from a combustion furnace having means communicating with the furnace for discharging said material which comprises:

a. a duct attached to the furnace discharge means, said duct defining an internal sluice chamber oriented in a generally downward direction relative to a horizontal plane and having an upper material inlet end portion and a lower discharge end portion;

b. a flap rotatably mounted with respect to said duct and positioned in such manner as to divide said duct into an upper chamber positioned to receive material from the combustion furnace and a lower chamber positioned to receive material from said upper chamber, said lower chamber defining a discharge opening;

c. means positioned below said lower chamber and configured and adapted to receive material passing from the upper end portion of the duct to the lower end portion of the duct and to accumulate such material in such manner as to obstruct the opening thereof to thereby form a substantially tight closure seal of said discharge opening of said lower end portion of the duct; and d. means for selectively displacing at least a portion of the accumulated material to a location directed away from the lower end portion of the duct and in a manner to maintain said closure seal of said duct discharge opening.

2. The apparatus according to claim 1 wherein said lower material reception means is arranged as a trough closed on all sides except for said discharge opening, in which trough is positioned, said material displacing means and its driving mechanism and controlling devices

3. The apparatus according to claim 1, wherein said material reception means is in the form of a trough configured to accumulate burnt material intermittently discharged from said upper chamber, and means is provided for selectively advancing said displacing means so as to discharge at least a portion of said material.

4. The apparatus according to claim 3, wherein said material displacing means comprises means engaging the lower wall of said material reception trough to displace said material therealong, and driving means positioned within said trough and operatively connected thereto to displace at least a portion of said material.

5. The apparatus according to claim 4, further comprising means to discharge a liquid medium mounted in a side wall of said upper chamber of said duct and capable of introducing a liquid into said sluice chamber at least a minimum rate sufficient to cool material accumulated within said upper chamber to predetermined temperatures.

6. The apparatus according to claim 5, wherein at least a bottom portion of said material reception means is configured generally cylindrically.

7. The apparatus according to claim 6, wherein said displacing means includes a scraper having a front end portion having a substantially cylindrically configuration and adapted to be slidably displaced along said substantially cylindrical bottom portion of said material reception means, and a rear portion thereof having a gear segment, a pivotally mounted gear sector which engages said gear segment, retaining means insuring engagement of said gear sector and said gear segment, and an actuating cylinder to selectively control displacement of said scraper so as to discharge at least at predetermined intervals at least a portion of said material accumulated in said trough.

8. An apparatus for removing burnt material such as clinker, combusted or uncombusted residual material and the like from a combustion furnace having means communicating with the furnace for discharging said material which comprises:

a. a duct attached to the furnace discharge means, said duct defining an internal sluice chamber oriented in a generally vertical downward direction relative to a horizontal plane and having an upper material inlet end portion and a lower discharge end portion;

b. a flap rotatably mounted with respect to said duct and positioned in such manner as to divide said duct into an upper chamber positioned to receive material from the combustion furnace and a lower chamber positioned to receive material from said upper chamber, said lower chamber defining a discharge opening;

c. trough means having a generally arcuate bottom portion positioned below said lower chamber and configured and adapted to receive material passing from the upper end portion of the duct to the lower end portion of the duct and to accumulate such material in such manner as to obstruct the opening thereof to thereby form a substantially tight closure seal of said discharge opening of said lower end portion of the duct; and d. means for selectively displacing at least a portion of the accumulated material generally horizontally along the generally arcuate bottom portion of said trough means to a location directed away from the lower end portion of the duct and in a manner to maintain said closure seal of said duct discharge opening.

* * * * *

UNITED STATES PATENT AND TRADEMARK OFFICE

CERTIFICATE OF CORRECTION

PATENT NO. : 4,020,773
DATED : May 3, 1977
INVENTOR(S) : Evald Blach

It is certified that error appears in the above-identified patent and that said Letters Patent are hereby corrected as shown below:

Column 2, line 54, "with" should read -- within --

Column 3, line 43, "of" should read -- to --

Column 5, line 3, "all" should read -- fall --

Column 6, line 25 (Claim 5, line 5), after "least" insert -- at --

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*